US007481893B2

(12) United States Patent
Motson et al.

(10) Patent No.: US 7,481,893 B2
(45) Date of Patent: Jan. 27, 2009

(54) CLEANING TEXTILES

(75) Inventors: Harold Russell Motson, Stockton on Tees (GB); Derek John Irvine, Stockton on Tees (GB); Trevor Graham Blease, Stockton on Tees (GB)

(73) Assignee: Croda International PLC, East Yorkshire (GB)

( * ) Notice: Subject to any disclaimer, the term of this patent is extended or adjusted under 35 U.S.C. 154(b) by 636 days.

(21) Appl. No.: 10/518,916

(22) PCT Filed: Jun. 24, 2003

(86) PCT No.: PCT/GB03/02703

§ 371 (c)(1),
(2), (4) Date: Jul. 27, 2005

(87) PCT Pub. No.: WO04/001119

PCT Pub. Date: Dec. 31, 2003

(65) Prior Publication Data

US 2005/0288201 A1 Dec. 29, 2005

(51) Int. Cl.
*B08B 7/00* (2006.01)

(52) U.S. Cl. ..... 134/30; 134/10

(58) Field of Classification Search ..... 134/10, 134/30

See application file for complete search history.

(56) References Cited

U.S. PATENT DOCUMENTS

| | | | | | |
|---|---|---|---|---|---|
| 5,267,455 | A * | 12/1993 | Dewees et al. | ..... | 68/5 C |
| 5,279,615 | A * | 1/1994 | Mitchell et al. | ..... | 8/142 |
| 5,370,742 | A * | 12/1994 | Mitchell et al. | ..... | 134/10 |
| 5,412,958 | A * | 5/1995 | Iliff et al. | ..... | 68/5 C |
| 5,431,843 | A * | 7/1995 | Mitchell et al. | ..... | 252/186.38 |
| 5,478,910 | A * | 12/1995 | Russell et al. | ..... | 528/274 |
| 5,486,212 | A * | 1/1996 | Mitchell et al. | ..... | 8/142 |
| 5,676,705 | A * | 10/1997 | Jureller et al. | ..... | 8/142 |
| 5,683,473 | A * | 11/1997 | Jureller et al. | ..... | 8/142 |
| 5,858,022 | A * | 1/1999 | Romack et al. | ..... | 8/142 |
| 5,977,045 | A * | 11/1999 | Murphy | ..... | 510/289 |
| 6,114,295 | A * | 9/2000 | Murphy | ..... | 510/286 |
| 6,148,645 | A | 11/2000 | DeYoung et al. | | |
| 6,200,352 | B1 | 3/2001 | Romack et al. | | |
| 6,258,766 | B1 | 7/2001 | Romack et al. | | |
| 6,313,079 | B1 * | 11/2001 | Murphy | ..... | 510/285 |
| 6,369,014 | B1 | 4/2002 | Murphy et al. | | |
| 6,482,784 | B2 * | 11/2002 | Murphy et al. | ..... | 510/285 |
| 6,548,466 | B1 * | 4/2003 | Murphy et al. | ..... | 510/285 |
| 6,558,432 | B2 | 5/2003 | Schulte et al. | | |
| 2002/0010965 | A1 | 1/2002 | Schulte et al. | | |
| 2002/0119898 | A1 * | 8/2002 | Kevelam et al. | ..... | 510/285 |
| 2002/0155966 | A1 * | 10/2002 | Murphy et al. | ..... | 510/285 |
| 2003/0060386 | A1 * | 3/2003 | Murphy et al. | ..... | 510/285 |
| 2004/0031107 | A1 | 2/2004 | Pegelow et al. | | |
| 2005/0288201 | A1 * | 12/2005 | Motson et al. | ..... | 510/285 |
| 2006/0178283 | A1 * | 8/2006 | Motson et al. | ..... | 510/285 |

FOREIGN PATENT DOCUMENTS

| | | |
|---|---|---|
| FR | 2171978 | 9/1973 |
| JP | 09-143497 | 6/1997 |
| JP | 09-176684 | 7/1997 |
| JP | 2001-514337 | 9/2001 |
| JP | 2002-543951 | 12/2002 |
| WO | WO94/01227 | 1/1994 |
| WO | WO99/10585 | 3/1999 |
| WO | WO00/42249 | 7/2000 |
| WO | WO00/70141 | 11/2000 |
| WO | WO01/06053 | 1/2001 |
| WO | WO02/33039 | 4/2002 |

* cited by examiner

*Primary Examiner*—Gregory E Webb
(74) *Attorney, Agent, or Firm*—Jones Day

(57) ABSTRACT

Cleaning media based on liquid $CO_2$ and including from 0.01 to 5% by weight of the formulation of a cleaning additive which is at least one $C_6$ to $C_{24}$ hydrocarbyl ester of a multi-carboxylic acid can be used in dry cleaning of textiles. Desirable cleaning additives are of the formula (I): $R^1(CO_2R^2)_n$ where $R^1$ is the residue of a $C_1$ to $C_{10}$ hydrocarbyl group from which n hydrogen atoms have been removed, $R^2$ is a $C_6$ to $C_{24}$ hydrocarbyl, particularly alkyl or alkenyl, group; and n is from 2 to 5; particularly $C_{12}$ to $C_{18}$ adipate esters.

11 Claims, No Drawings

CLEANING TEXTILES

CROSS REFERENCE TO RELATED APPLICATIONS

This application is the National Phase application of International Application No. PCT/GB2003/002703,filed Jun. 24, 2003, which further claims the benefit of International Application No. PCT/GB/2002/0002846, filed Jun. 24, 2002, both of which designate the United States and were published in English. These applications, in their entirety, are incorporated herein by reference.

This invention relates to cleaning textile materials and products including clothes using liquid carbon dioxide ($CO_2$) and cleaning additives.

The dry cleaning of clothes using fluid carbon dioxide, either as liquid or supercritical fluid, is known from many patents. An early suggestion is in U.S. Pat. No. 4,012,194 (Maffei) which teaches simply using liquid carbon dioxide as a substitute for halocarbon solvents e.g. perchlorethylene (perc), used in conventional dry cleaning. Later patents develop approaches using detergent materials, including U.S. Pat. Nos. 5,676,705, 5,683,473, 5,683,977, 6,131,421, 6,148,644, and 6,299,652 assigned to Unilever and their equivalents, which relate to the use of defined detergents based on various classes of polymers and a series of cases, including U.S. Pat. Nos. 5,858,022, 6,200,352, 6,280,481, 6,297,206, 6,269,507 and US published application 200106053 A, assigned to MiCell and their equivalents. Also U.S. Pat. No. 5,279,615 assigned to Chlorox Co uses cleaning non-polar organic cleaning adjuncts, especially alkanes, in densified, particularly supercritical $CO_2$.

This invention is based on a liquid $CO_2$ dry cleaning medium including esters of multi-carboxylic acids as cleaning additives which improve the cleaning performance of the liquid $CO_2$ and give improved handling characteristics as compared with the use of detergents available for use with liquid $CO_2$.

The invention accordingly provides a dry cleaning medium based on liquid $CO_2$ and including from 0.01 to 5% by weight of the cleaning medium of a cleaning additive which is at least one $C_6$ to $C_{24}$ hydrocarbyl ester of a multi-carboxylic acid.

The invention includes a method of dry cleaning which includes contacting textile material, particularly clothes, with a dry cleaning medium based on liquid $CO_2$ and including from 0.01 to 5% by weight of the cleaning medium of a cleaning additive which is at least one $C_6$ to $C_{24}$ hydrocarbyl ester of a multi-carboxylic acid.

The cleaning media of and used in this invention are desirably surfactant free and desirably micelle free.

In the present invention by describing compounds as "multi-carboxylic acids" we mean that they are carboxylic acids having 2 or more carboxylic acid groups. Also, in describing cleaning media as "surfactant free" we mean that they do not include surface active amphiphilic materials that aid soil removal from textiles and in describing cleaning media as "micelle free" we mean that the cleaning medium does not contain micelles of cleaning additives.

The cleaning additive esters used in this invention are desirably of the formula (I):

$$R^1(CO_2R^2)_n \quad (I)$$

where $R^1$ is the residue of a $C_1$ to $C_{10}$ hydrocarbyl group from which n hydrogen atoms have been removed; and each $R^2$ is independently a $C_6$ to $C_{24}$ hydrocarbyl, particularly alkyl or alkenyl, group; and n is from 2 to 5.

Compounds of the formula (I) are esters of a multi-carboxylic acid and an alcohol particularly a mono-hydroxy alcohol. Examples of compounds of the formula (I) include di-esters of dicarboxylic acids such as succinic, glutaric and particularly adipic acids.

The number of carboxylic ester groups in the molecules can be from 2 to 6, but is desirably 2 because such materials are commercially available. Thus, the group $R^1$ is desirably —$(CH2)_m$—where m=2 to 6, particularly 2 to 4, especially 4 (the corresponding di-carboxylic acid is adipic acid).

In this invention, the hydrocarbyl groups $R^2$ are each independently a $C_6$ to $C_{24}$ i.e. a relatively long chain, particularly alkyl or alkenyl, group. In particular $R^2$ is a $C_8$ to $C_{20}$, more particularly a $C_{10}$ to $C_{20}$, especially a $C_{12}$ to $C_{18}$ alkyl or alkenyl group. The groups $R^2$ can have linear or branched chains, though generally branched chain materials are desirable. The compounds of the formula (I) may include mixed $R^2$ groups having differing chain lengths and/or cleaning agents may include a mixture of compounds of the formula (I) having $R^2$ groups with differing chain lengths. An example of such combinations of differing chain lengths is the mixture of chain lengths found in iso-stearyl groups because commercial "iso-stearyl alcohol" is a mixture of alcohols of different chain length, typically ranging from about $C_{14}$ to about $C_{22}$ and averaging about $C_{18}$ with a wide range of mainly branched isomers of the varying chain lengths. The use of mixed ester materials of can provide more liquid additives (having a lower freezing point) as compared with single compounds of similar chain length, and may also have better solubility no liquid $CO_2$.

The groups $R^2$ may be saturated or unsaturated—unsaturated groups may provide greater liquidity or lower freezing point as compared with saturated materials of equal chain length, but will generally have poorer oxidative stability and for this reason saturated materials will generally be preferred.

Our copending PCT application PCT/GB 02/02846 (published as WO . . . A) describes the use of multi-esters (esters compounds having 2 or more carboxylic acid ester groups) with molecular weights of not more than 750 as cleaning additives in using liquid $CO_2$ based dry cleaning systems. Particular examples of such multi-esters include lower alkyl di-esters, particularly dimethyl esters, of mixtures of succinic, glutaric and adipic acids. These additives can boost the cleaning effectiveness of liquid $CO_2$ based dry cleaning systems even at low levels of addition in the cleaning medium. However, particularly the di-methyl esters have the disadvantages that they have pronounced odours and that the cleaning additive itself is a solvent of polyacetate polymer and thus some care is needed in using these additives to ensure that clothes including polyacetates are not damaged by direct contact with the neat cleaning additive.

The ester materials, including relatively long chain groups $R^2$, used in this invention have certain advantage as compared with shorter chain particularly methyl esters. Generally they have a lower odour and/or an odour that can be more readily masked e.g. using added fragrances, than the shorter chain, especially methyl, esters. Further as is noted above the shorter chain, particularly methyl esters can have an adverse (solvent) effect on acetate fabrics. These effects appear to include a tendency to extract dyes from acetate fabrics and even to dissolving the polymer to the extent of disrupting the fabric if the undiluted methyl esters come into direct contact with acetate fabrics. The longer chain esters used in this invention have a much lower tendency to affect acetate fibre or fabrics—our tests indicate no significant tendency to dissolve such fabrics or to or extract dyes from them.

Further the longer chain ester used in this invention appear to give a useful improvement in cleaning of oily or waxy soils as compared with the shorter chain, particularly methyl esters.

The precise mode of action of these cleaning additives in dry cleaning is not clear. They appear to boost the overall cleaning performance of liquid $CO_2$ but operating at levels that are significantly lower that would be expected to be effective if the effect were simply additive co-solvency. In addition, the use of these additives gives improved handling of textiles cleaned using them as compared with no cleaning additives or commercially available detergents for use in liquid $CO_2$.

The molecular weight of the cleaning additive is generally within the range 200 to 1000, more usually from 250 to 800, desirably from 300 to 750, and particularly from 350 to 700. Thus, molecular weights for individual compounds of the formula (I) can be, for example, 370 for dioctyl or di-2-ethylhexyl adipate, 426 for di-decyl or di-isodecyl adipate, 510 for di-tridecyl or di-iso-tridecyl adipate, 650 for di-stearyl adipate (straight or branched chain stearyl) and about 650 for di-iso-stearyl adipate (bearing in mind that commercial "iso-stearyl" alcohol is a mixture of alcohols of different chain length averaging about C18).

The esters of multi-carboxylic acids may be used in conjunction with other cleaning additives, particularly non-surfactant cleaning additives. Although mixtures with multi-esters particularly di-lower alkyl, di-methyl-ethyl or -propyl, particularly d-methyl, esters of succinic, glutaric and adipic acids, more particularly the mixed di-methyl esters of succinic, glutaric and adipic acids [as more fully described in PCT application PCT/GB 02/02846 (published as WO . . . A)], the use of such lower alkyl esters may give rise to solubility issues with acetate fabrics. To reduce this it is desirable that the proportion of such lower alkyl esters is not more than about 50% e.g. 10% to 50% of the total mixed cleaning additive.

The amount of cleaning additive ester present in the cleaning medium is from 0.01 to 5%, usually from 0.05 to 2%, more usually from 0.1 to 1%, particularly from 0.1 to 0.5% and more particularly from 0.1 to 0.3% by weight of the cleaning medium. The use of lower amounts of cleaning additive will not generally give useful results and use of larger amounts does not appear to give additional benefits and may result in including so much additive in the system that additive residues are deposited onto the textiles being cleaned or left on the walls of the cleaning apparatus.

Other ingredients can be included in the dry cleaning formulation such as fragrances, optical brighteners, fabric conditioners such as softeners, and sizes e.g. starch, enzymes, bleaches, particularly peroxide bleaches e.g. organic and/or inorganic peroxides or hydrogen peroxide or a source of hydrogen peroxide.

In the overall cleaning process, the textile material, particularly clothes, may be pre-treated to improve the overall level of cleaning achieved. This will typically concentrate on areas of the textile that carry specific soils. Such pre-treatment of soiled areas is commonly called "pre-spotting" and is used to improve the overall cleaning particularly where the normal cleaning process is not especially good at removing the specific soil concerned. The materials used in pre-spotting are commonly called "pre-spotters" and examples of pre-spotters for use in liquid $CO_2$ based dry cleaning systems described in EP 0518653 A (Chlorox) include alkanes, particularly paraffin oils, alcohols, aldehydes, carboxylic acids, ketones and esters, particularly for improving the removal of non-polar stains.

The textiles to be cleaned will usually be garments and can be of woven or non-woven fabrics. The fibre making up the fabric can be or include a wide range of natural and synthetic fibres including polyamides particularly natural polyamides such as silk and wool and synthetic polyamides such as nylon, cellulosic fibres such as cotton, linen and rayon, synthetic polymers such as polyester, particularly polyethylene terephthalate or related copolymers, or acetate polymers. As is noted above, an advantage of this invention is that the esters of multi-carboxylic acids used as cleaning additives do not appear to have adverse effects on acetate polymers.

The particular mode of operation will depend on the equipment used. Generally the cleaning will be carried out in a drum, which may have its axis vertical or horizontal. The textiles are introduced into the drum which is then sealed and filled with the cleaning medium including carbon dioxide typically to give a mixture of liquid and gaseous $CO_2$ in the drum. The textiles and liquid $CO_2$ based cleaning medium are then agitated to give thorough mixing and contact between the cleaning medium and textiles. The textiles will be contacted with the cleaning medium for a time adequate to clean the textiles to the desired extent. The cleaning medium is then separated from the textiles, typically by draining or venting it from the drum. Generally the textiles will be subject to one such cleaning cycle, but if desired the cleaning cycle may be repeated to obtain a higher degree of cleaning. Usually, the textiles are subject to at least one rinse cycle with liquid carbon dioxide usually not including cleaning additives, but which may include fabric softeners, optical bleaches etc if desired. The rinse liquid is similarly separated from the textiles, which can then recovered by de-pressurising the drum and opening it to removed the textiles.

Among fabric conditioners or softeners that can be used in rinse cycles according to the invention we particularly include fatty branched polyalkoxylates, particularly fatty alcohol, branched polyalkoxylates, especially propoxylates. We have found that such materials can give improved softness and handling characteristics to textiles, particularly clothes, after treatment. In this context, the term "branched polyalkyloxylate" refers to polyalkoxylate chains including a substantial proportion of units which have side chains e.g. as provided by propyleneoxy or butyleneoxy units. The term "fatty branched polyalkyloxylate" refers collectively to branched polyalkyloxylate based on fatty alcohols or fatty acids. The use of fatty branched polyalkoxylates as such conditioning or softening agents is described in our copending PCT application PCT/GB 02/03828 (published as WO 2004/018764A).

The invention accordingly includes a method of dry cleaning which includes a cleaning step which includes contacting textile material, particularly clothes, with a dry cleaning medium based on liquid $CO_2$ and including a cleaning additive which is or includes at least one ester of a hydroxycarboxylic acid, followed by a conditioning step in which textile material, particularly clothes, is contacted with a treatment medium based on liquid $CO_2$ and which includes a conditioning agent which is or includes at least one fatty alcohol or fatty acid branched polyalkyloxylate.

Materials that are desirable as conditioners in this aspect of the invention include alcohol branched polyalkoxylates of the formula (III):

$$R^3O(AO)_mR^4 \quad \text{(III)}$$

where $R^3$ is a $C_8$ to $C_{30}$ aliphatic hydrocarbyl group, particularly an alkyl or alkenyl group, or a $C_8$ to $C_{30}$ aliphatic acyl group;

AO is an alkyleneoxy group and is at least predominantly branched alkyleneoxy, particularly propyleneoxy;

m is from 2 to 50, particularly 2 to 30; and $R^4$ is H or a is a $C_1$ to $C_4$ aliphatic hydrocarbyl group, particularly an alkyl group, or a $C_1$ to $C_4$ acyl group, particularly an acetyl group.

When the group $R^3$ is an aliphatic hydrocarbyl group, particularly an alkyl or alkenyl group. Within the chain length range $C_8$ to $C_{30}$, the group has from $C_8$ to $C_{22}$, particularly $C_{12}$ to $C_{20}$, and especially $C_{16}$ or $C_{18}$, carbon atoms. The hydrocarbyl group is desirably an open chain group and may be linear or branched or a mixture of linear and branched chains. The groups may be saturated or unsaturated or a mixture of saturated and unsaturated groups.

When the group $R^3$ is an aliphatic acyl group, desirably it has from $C_8$ to $C_{22}$, particularly $C_{12}$ to $C_{20}$, and especially $C_{16}$ or $C_{18}$, carbon atoms. The acyl group is desirably an open chain group and may be linear or branched or have a mixture of linear and branched chains. The chains may be saturated or unsaturated or a mixture of saturated and unsaturated chains.

The alkyleneoxy groups, -AO—, are typically all $C_2$ to $C_4$ groups while being predominantly branched alkyleneoxy e.g. propyleneoxy and/or butyleneoxy. In this context "predominantly" means that the molar proportion of branched alkyleneoxy residues in the polyalkyleneoxy chain is at least 50%. Desirably all the residues are all propyleneoxy and/or butyleneoxy residues. Mixed alkylene oxide chains may be used such as:

mixtures of propyleneoxy and butyleneoxy residues, when the molar ratio of propyleneoxy residues to butyleneoxy residues will usually be from 99:1 to 1:99 (more extreme ratios substantially correspond to chains made entirely of the majority residue), more usually from 10:1 to 1:10;

mixtures of propyleneoxy and ethyleneoxy residues, when the proportion of ethyleneoxy residues will usually not be more than 20%, more usually not more than 10% and desirably not more than 5%, of the total of propyleneoxy and ethyleneoxy residues; or mixtures of butyleneoxy and ethyleneoxy residues, when the proportion of ethyleneoxy residues will usually not be more than 50%, more usually not more than 25% and may be not more than 10%, of the total of butyleneoxy and ethyleneoxy residues.

When the alkyleneoxy residues are mixed, the polyalkyleneoxy chain can be a random or block copolymeric chain. Within the range 2 to 50, m is desirably 2 to 30, more usually 5 to 25 and usually 7 to 20 The number of units in the polyalkyleneoxy chain, 'm', is an average value and may be non-integral.

The group $R^4$ is H, or an end capping group such as a lower alkyl group e.g. a $C_1$ to $C_4$ alkyl group, and when other than H is desirably a methyl or ethyl group, or a $C_1$ to $C_4$ acyl group, particularly an acetyl group.

It is further desirable that the combined number of carbon atoms in the groups $R^3$ and $R^4$ is from 9 to 26 particularly from 15 to 24.

Desirably in compounds of the formula (III) when used in this invention, the ratio of carbon atoms in the groups $R^3$ to the number of repeat units in the polyalkylene oxide chain $-(AO)_n-$ is from 8:1 to 1:4, particularly 6:1 to 1:2.

The amount of the conditioning agent alcohol branched polyalkyloxylate present in the cleaning medium is from 0.001 to 2.5%, usually from 0.005 to 2%, more usually from 0.01 to 1%, particularly from 0.01 to 0.1% and more particularly from 0.01 to 0.5% by weight of the cleaning medium. The use of lower amounts of conditioning agent will not generally give useful results and use of larger amounts does not appear to give additional benefits and may result in including so much conditioning agent in the system that conditioning agent residues are deposited onto the textiles being cleaned or left on the walls of the cleaning apparatus.

Any suitable apparatus for dry cleaning with liquid carbon dioxide can be used. Typically such apparatus includes a drum in which the cleaning is carried out. The drum may have its axis horizontal or vertical. (Other angles of orientation will generally be less convenient in operation.)

Providing agitation in a horizontal axis drum can simply be by rotation around its axis. Vertical axis drums will usually include an agitator which can be moved to agitate the drum contents. Other means of agitation include paddles or vanes in the drum or by jetting liquid $CO_2$ into the mixture of cleaning medium and textiles in the drum. Suitably vigorous agitation may give rise to cavitation in the cleaning medium and this may improve the cleaning performance.

Typically the cleaning temperature will be from −10 to 28° C., more usually up to 27° C., particularly up to 25° C. The operating temperature will not usually be above these temperatures, particularly about 27° C., to maintain the cleaning medium a reasonable margin from the critical point of $CO_2$, because supercritical $CO_2$ may extract textile dyes from fabrics. Operating at or near ambient temperature simplifies operation of the process, but using a lower temperature means that the $CO_2$ is more dense and a more effective cleaning agent. Thus the temperature is desirably at least 5° C. more usually at least 10° C. and temperatures generally in the range from 10 to 25° C., particularly 20 to 25° C., provide a reasonable balance of properties and are thus advantageous.

During cleaning the cleaning medium must be kept at a pressure which maintains the $CO_2$ at least partially as a liquid. This will usually be the vapour pressure of the cleaning medium at the temperature of operation because, as is noted above, it is desirable for both liquid and gaseous $CO_2$ to be present. At the operating temperatures noted above, the corresponding pressures are approximately 2.7 to 6.9 MPa, more usually up to 6.7 MPa, particularly up to 6.4 MPa; desirably at least 4 MPa, more usually at least 4.5 MPa; and generally in the range from 4.5 to 6.4 MPa, particularly 5.7 to 6.4 MPa, The invention is illustrated by the following Examples. All parts and percentages are by weight unless otherwise indicated.

Materials

CA1 di-iso-C10 adipate

CA2 di-iso-C13 adipate

CA2 di-stearyl adipate (made using a guerbet branched steary alcohol.

CD1 dimethyl ester of a mixture of adipic, glutaric and succinic acids (ca 1:1:3 molar)

Cleaning testing used cloths stained with red candle wax.

Cleaning effectiveness—was assessed spectrometrically (using an X-Rite Spectrophotomeric Colour Measurement system) by comparison of the soiled cloths before and after cleaning with the results given as % stain removal.

EXAMPLE 1

Various cleaning additives were tested for efficacy in removing stains from standard stained cloths using the experimental cleaning machine and method set out below.

Test Cleaning Procedure

An experimental cleaning machine is based on a pressure cylinder ca 50 cm long by 15 cm diameter (external); internal volume ca 6 l as the cleaning vessel. Connections are provided to enable the cylinder to be filled with carbon dioxide and emptied and for holding test cloths in the vessel.

Soiled fabric samples are held in place inside the pressure cylinder, the desired additive (5 ml) is introduced into the bottom of the cylinder using a syringe and the cylinder sealed. The cylinder is filled initially with gaseous carbon dioxide (to a minimum of 30 bar pressure) and then the desired quantity, about 2 l (measured by logging the weight loss of the supply cylinder), of liquid carbon dioxide is introduced. The supply connections are removed and the test cylinder is rotated end over end for a predetermined time. The cylinder is then suspended with its axis vertical so that the 'dirty' liquid drains away from the washed fabric samples under gravity. The 'dirty' liquid $CO_2$ is vented to atmosphere. A rinse stage is normally carried out by repeating the filling process but without using any cleaning additive. The fabric samples are then removed from the machine removed and the stains examined using a computer controlled spectrophotomeric colour measurement system.

The cleaning conditions and the results obtained are set out in Table 1 below:

TABLE 1

| Ex No | Wash Time (min) | Rinse Time (min) | Temp (°C.) | Additive type | Additive (% v/v) | Soil Removal (%) |
|---|---|---|---|---|---|---|
| 1.C.1 | 15 | 15 | Ambient | none | — | 13.2 |
| 1.C.2 | 15 | 15 | Ambient | CD1 | 0.25 | 14.6 |
| 1.1 | 15 | 15 | Ambient | CA1 | 0.25 | 16.6 |
| 1.2 | 15 | 15 | Ambient | CA2 | 0.25 | 20.6 |

EXAMPLE 2

Esters CA2 and CA3 were compared with CD1 for odour and their effect on acetate fabric.

A sample of each ester tested was placed in an open bottle with an air space to allow the odour of the ester to be detected by smell. The smell was rated on a scale of 1 (no smell detected) to 4 (strong odour) by two observers and the average results are summarised in Table 2 below.

Similarly for each ester tested, a piece of black dyed acetate fabric about 1 cm square was placed in a small bottle and about 10 ml of neat ester were pipetted into the bottle to thoroughly wet and cover the fabric. After 5 minutes the ester was decanted into a fresh bottle and the remaining fabric probed with a spatula to investigate its integrity. The results are set out in Table 2 below.

TABLE 2

| Ex No | Additive | Odour | Decanted Ester | Effect on Cloth |
|---|---|---|---|---|
| 2.C.1 | CD1 | 4 | strong purple colour | cloth disrupted - some yarns dissolved |
| 2.1 | CA2 | 1.5 | colourless clear | cloth wet but otherwise not visibly affected |
| 2.2 | CA3 | 1 | colourless clear | cloth wet but otherwise not visibly affected |

The invention claimed is:

1. A method of dry cleaning, comprising contacting a textile material with a dry cleaning medium based on liquid $CO_2$ and including from 0.01 to 5% by weight, relative to the total weight of the dry cleaning medium, of a cleaning additive that comprises a $C_6$ to $C_{24}$ hydrocarbyl ester of a multi-carboxylic acid.

2. A method as claimed in claim 1 wherein the $C_6$ to $C_{24}$ hydrocarbyl ester of the multi-carboxylic acid includes at least one compound of the formula (I):

$$R^1(CO_2R^2)_n \quad \text{(I)}$$

where $R^1$ is the residue of a $C_1$ to $C_{10}$ hydrocarbyl group from which n hydrogen atoms have been removed;

$R^2$ is a $C_6$ to $C_{24}$ hydrocarbyl group; and n is from 2 to 5.

3. A method as claimed in claim 2 wherein $R^2$ is a $C_8$ to $C_{20}$ alkyl group.

4. A method as claimed in claim 3 wherein $R^2$ is a $C_{12}$ to $C_{18}$ alkyl group.

5. A method as claimed in claim 1 wherein the $C_6$ to $C_{24}$ hydrocarbyl ester of the multi-carboxylic acid is an ester of adipic acid or a mixture containing such an ester.

6. A method as claimed in claim 1 wherein the average molecular weight of the $C_6$ to $C_{24}$ hydrocarbyl ester of the multi-carboxylic acid is from 300 to 750.

7. A method as claimed in claim 1 wherein the dry cleaning medium includes from 0.1 to 0.5% by weight of the cleaning additive, relative to the total weight of the dry cleaning medium.

8. A method as claimed in claim 1 in which the dry cleaning medium additionally includes at least one fragrance, optical brightener, fabric conditioner, enzyme and/or bleach.

9. A method as claimed in claim 1 wherein the cleaning process is carried out at a temperature of from −5 to 25° C.

10. A method as claimed in claim 9 wherein the temperature is from 10 to 25° C.

11. A method as claimed in claim 10 wherein the temperature is from 20 to 25° C.

* * * * *